US009549627B1

(12) United States Patent
Grady

(10) Patent No.: US 9,549,627 B1
(45) Date of Patent: Jan. 24, 2017

(54) BEVERAGE STAND

(71) Applicant: Jeffrey T. Grady, Bartlett, IL (US)

(72) Inventor: Jeffrey T. Grady, Bartlett, IL (US)

( * ) Notice: Subject to any disclaimer, the term of this patent is extended or adjusted under 35 U.S.C. 154(b) by 0 days.

(21) Appl. No.: 15/133,568

(22) Filed: Apr. 20, 2016

(51) Int. Cl.
*A47G 23/02* (2006.01)
*F16M 11/24* (2006.01)

(52) U.S. Cl.
CPC ..... *A47G 23/0208* (2013.01); *F16M 11/24* (2013.01)

(58) Field of Classification Search
CPC ..... A47G 23/0208; F16M 11/24
USPC ..... 211/85.4; D7/401.2, 704, 707
See application file for complete search history.

(56) References Cited

U.S. PATENT DOCUMENTS

D467,127 S * 12/2002 Wright ..... D1/105
D559,050 S * 1/2008 Mungal ..... D7/704
D587,076 S * 2/2009 Grady ..... D7/704
7,641,156 B2 1/2010 Medders et al.
7,984,813 B1 * 7/2011 Tapager ..... A47G 23/02 211/74
D651,454 S * 1/2012 Chin ..... D7/401.2
8,201,794 B1 6/2012 Pesola
8,590,715 B2 * 11/2013 Gray ..... A47F 7/0064 211/181.1
9,016,651 B2 4/2015 Webb
9,089,234 B2 7/2015 Webb
9,220,337 B1 12/2015 Wenzel

* cited by examiner

*Primary Examiner* — Korie H Chan
(74) *Attorney, Agent, or Firm* — Botkin & Hall, LLP

(57) ABSTRACT

A drink stand is provided having a base portion that is designed to rest on the ground or other horizontal surface. A top portion is designed to be affixed to the base portion through a support rod. The top portion is surrounded by a continuous loop that includes stemware holders where a portion of the loop is bent inward to form an opening. The top portion includes a centrally located large vessel holder. Cup holders with a gap adapted to receive a handle are affixed between the loop and the large vessel holder. A support rod is included with the cup holder that has a bent floor portion that effectively forms a planar surface that supports the bottom of the cup.

19 Claims, 6 Drawing Sheets

BEVERAGE STAND

BACKGROUND OF THE INVENTION

This present disclosure relates to drink stands that are made to rest on a surface. The current art is populated with various devices that will either sit on the ground or be driven into the ground and provide a table or tray portion that can hold a drink. Many of these have moving parts, require assembly, are complicated, do not store in a compact fashion, or are simply not stable. Many are made with plastic that can crack or break and does not hold up to rough handling. Further, they do not provide any flexibility for various types of drinks, such as wine glasses, cans of soda, and cups that have handles. An improved drink holder is needed.

SUMMARY OF THE INVENTION

The present disclosure describes a drink or beverage stand made from bent and welded metal wire. The stand is made up of three separate parts, the top, the rod, and the base. These three parts are then assembled together to form the drink stand. The rod threads into the top and the base to complete assembly. The top has a centrally located holder that will hold a larger vessel, such as a wine bottle. The top also has two wine glass holders that have openings for stemware located adjacent the large vessel holder. Located also on the top are two cup holders that have a circular opening with an interruption to allow for the handle of a mug or cup. Extending downward from the cup holder is a cradle formed with several bends to create a floor that supports the cups. The geometry of the cradle is minimalist but still retains most commercially available cans, bottles, and glasses. The base has a larger diameter than the top in order to increase stability. The rod is threaded but also has jamb nuts that allow multiple secure positions of assembly.

BRIEF DESCRIPTION OF THE DRAWINGS

A preferred embodiment of this invention has been chosen wherein.

DESCRIPTION OF THE PREFERRED EMBODIMENT

Figure 1:
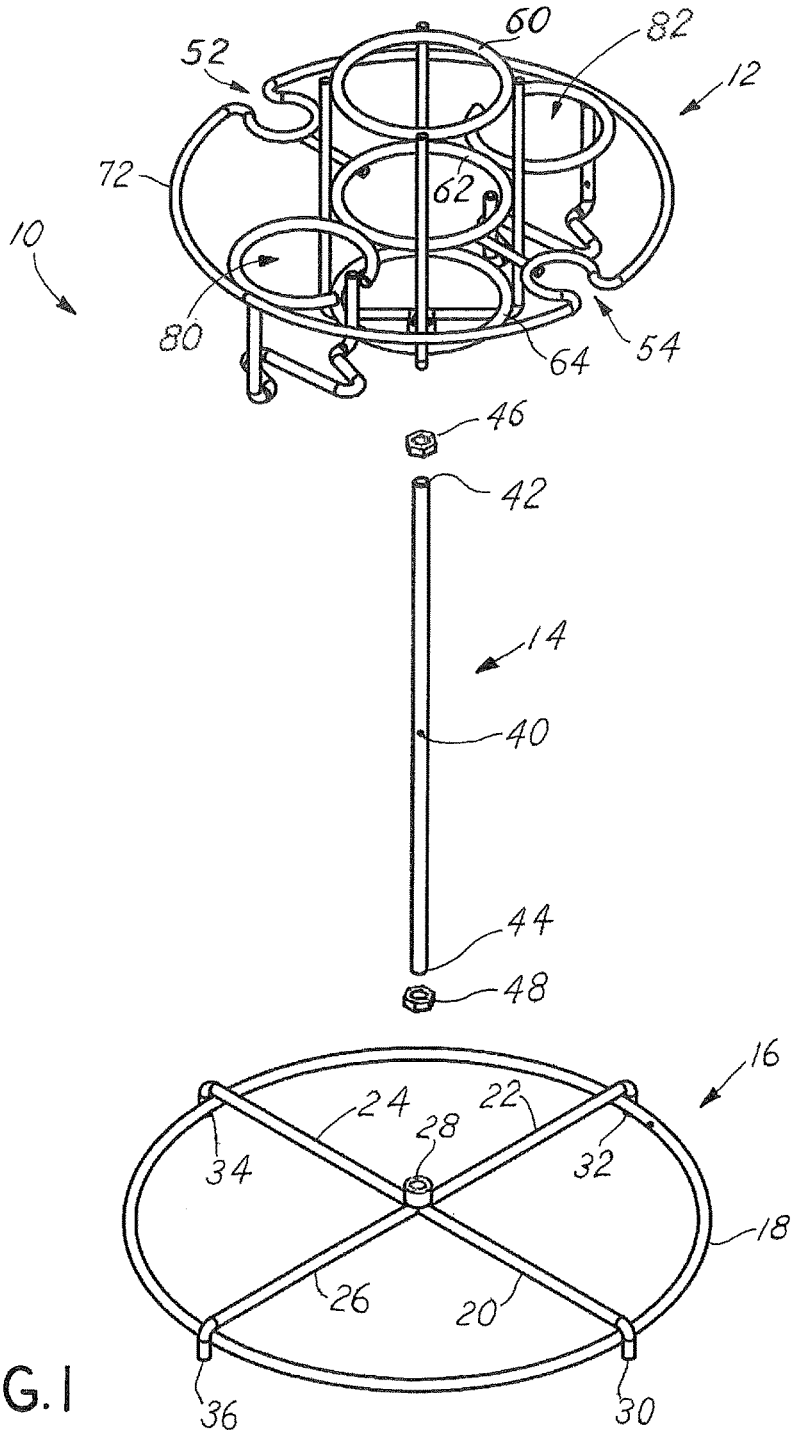
FIG. 1 is an isometric exploded view of the stand.

A beverage stand 10 is shown in FIG. 1 has a top 12, a rod 14, and a base 16. The base 16 is designed to rest on the ground 11 or other horizontal surface. The base 16 is formed from bent metal wire that is welded together, but other methods of connecting the individual pieces are contemplated, such as screws, rivets, or adhesive. The base 16 has a circular outer ring 18 and four rods 20, 22, 24, and 26 meet in the center of the ring 18. At the center of the ring 18, a threaded receiver 28 is located that extends perpendicular to the plane formed by the outer ring 18. As shown, each of the four rods have a foot 30, 32, 34, and 36 that will directly contact the ground 11. The outer ring 18 stabilizes each of the rods 20, 22, 24, and 26. As shown, the feet 30, 32, 34, and 36 protrude to one side of the outer ring 18, but it is contemplated they are flush. It is further contemplated that the outer ring 18 itself rests directly on the ground 11.

The rod 14 is formed from an elongate length of metal 40 with a first threaded end 42 and a second threaded end 44. The rod 14 is symmetrical so the threaded ends 42, 44 can be swapped without affecting the fitment of the other parts. Threaded onto the threaded ends 42, 44 are jamb nuts 46, 48. The jamb nuts 46, 48 allow the rod 14 to be affixed to the top and bottom 12, 16 without having to bottom out the threads on the threaded receiver 28.

The top 12, like the base 16, is formed from bent and welded metal wire. The top 12 is significantly more complex and is assembled from many individual bent wire components that are welded together. The top 12 has several portions, the large vessel holder 50, the stemware holders 52, 54, and the cup holders 80, 82. The large vessel holder 50 is made to hold a wine bottle (not shown) or equivalent sized vessel. It is circular and is sized to accept a cooling sleeve (not shown). The cooling sleeve would fit inside the large vessel holder 50 and have an open top, a continuous sidewall, and a closed bottom such that it could hold a liquid, such as ice water. The cooling sleeve would be large enough to accept a wine bottle and the liquid would help maintain the temperature of the bottle. The large vessel holder 50 has a top ring 60, a center ring 62, and a bottom ring 64, all of which are shown having the same diameter. The top ring 60, center ring 62, and bottom ring 64 are shown as parallel circular components that are spaced from each other. It is contemplated that the rings 60, 62, 64 are different diameters. Support rods 66 hold the rings 60, 62, and 64 in place. The support rods 66 are bent adjacent around and affixed to the bottom ring 64 to form a floor portion 68 and meet at a center point where a threaded receiver 70 is affixed. The threaded receiver 70 is sized to accept one of the threaded ends 42, 44 of the rod 14. The center points of the rings 60, 62, 64, a major diameter 72 of the top 12, and the threaded receiver 70 all align to form a central axis that is perpendicular to their respective diameters. When the top 12 is affixed to the bottom 16 through the rod 14, the center points of the components are intersected by the central axis.

Figure 2:
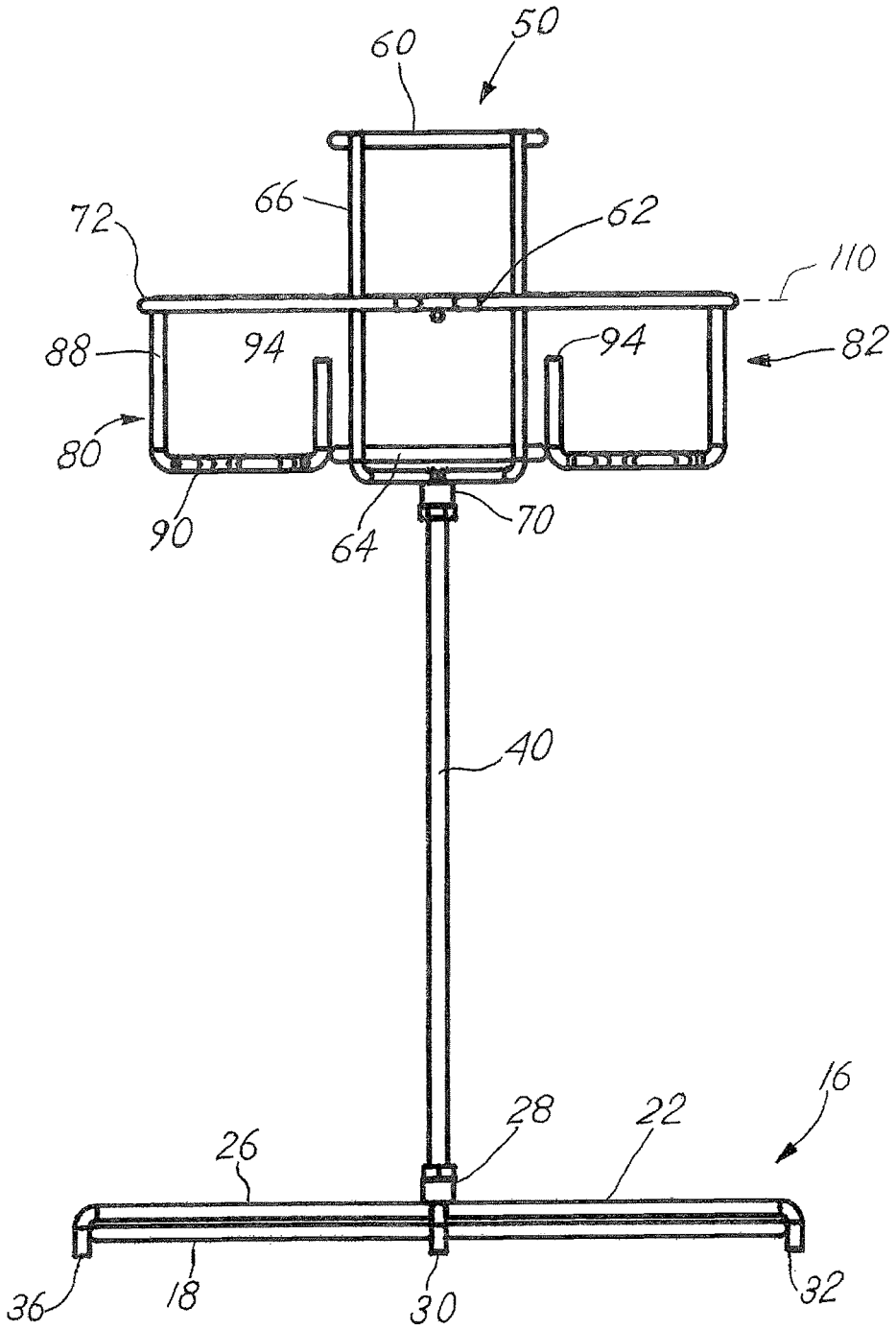
FIG. 2 is a front view of the stand.
Figure 3:
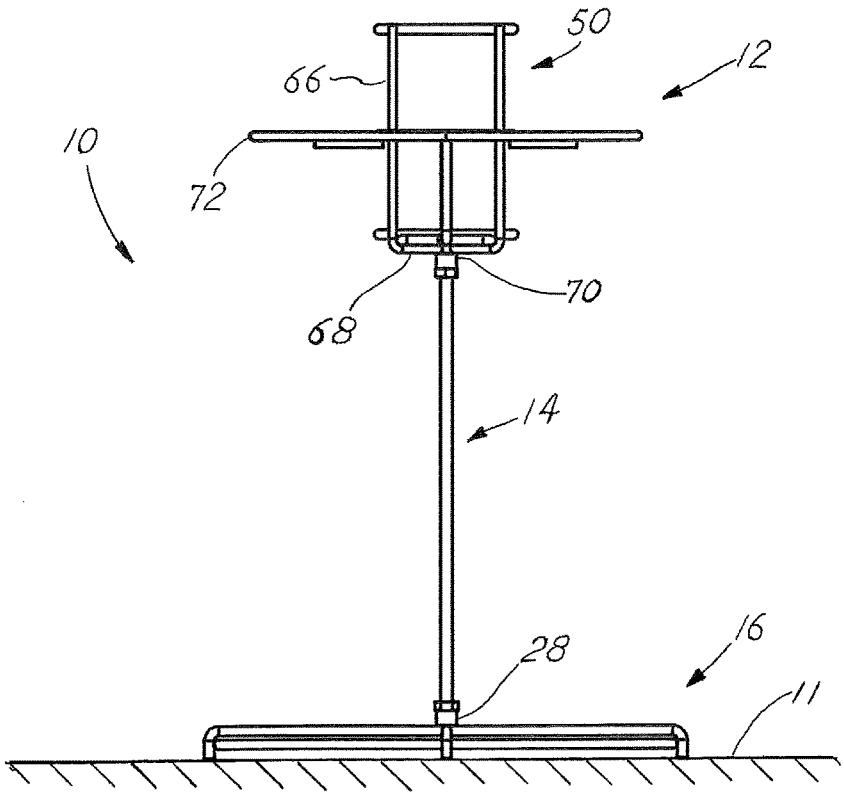
FIG. 3 is a side view of the stand.
Figure 4:
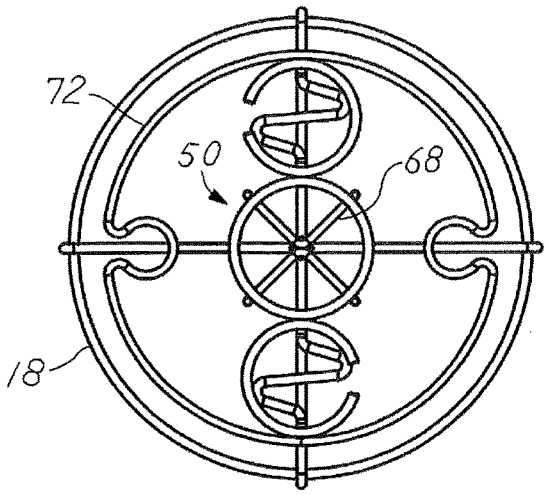
FIG. 4 is a top view of the stand.
Figure 6:
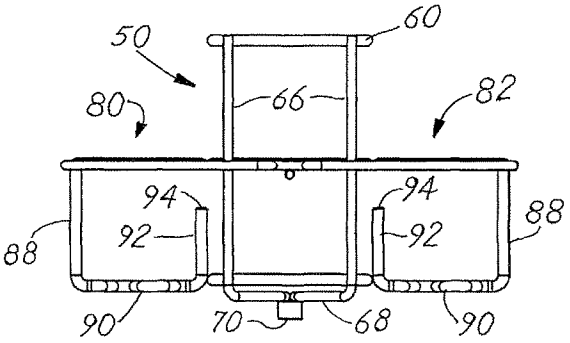
FIG. 6 is a front view of the top portion of the stand as shown in FIG. 2.
Figure 8:
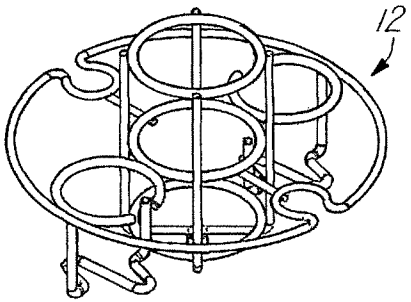
FIG. 8 is an isometric view of the top portion of the stand as shown in FIG. 1.
Figure 5:
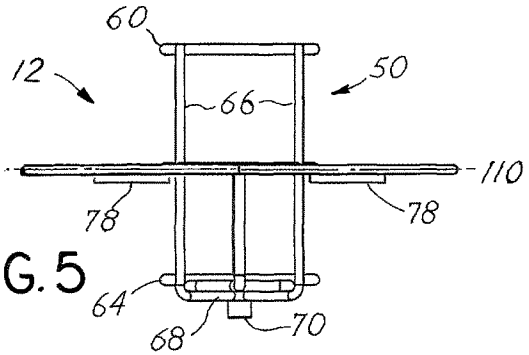
FIG. 5 is a side view of the top portion of the stand as shown in FIG. 3.
Figure 7:
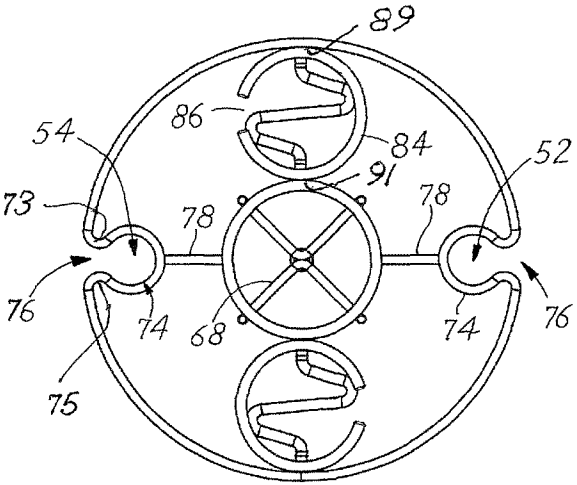
FIG. 7 is a top view of the top portion of the stand as shown in FIG. 4.
Figure 10:
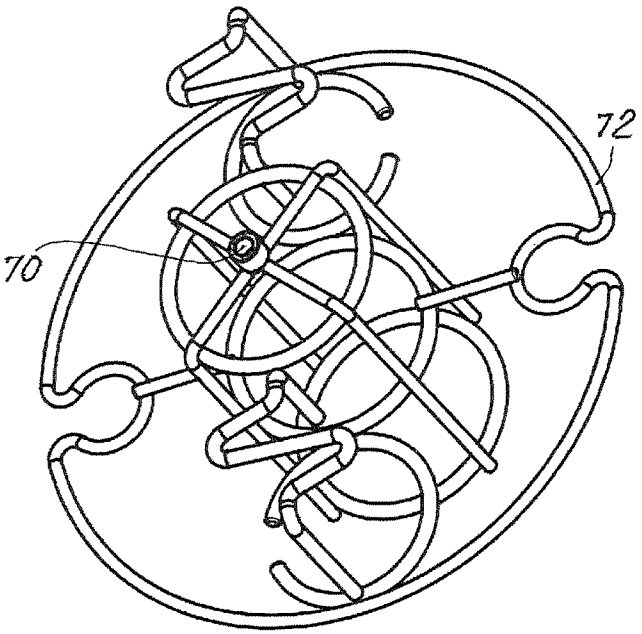
FIG. 10 is a bottom isometric view of the top portion of the stand.
Figure 9:
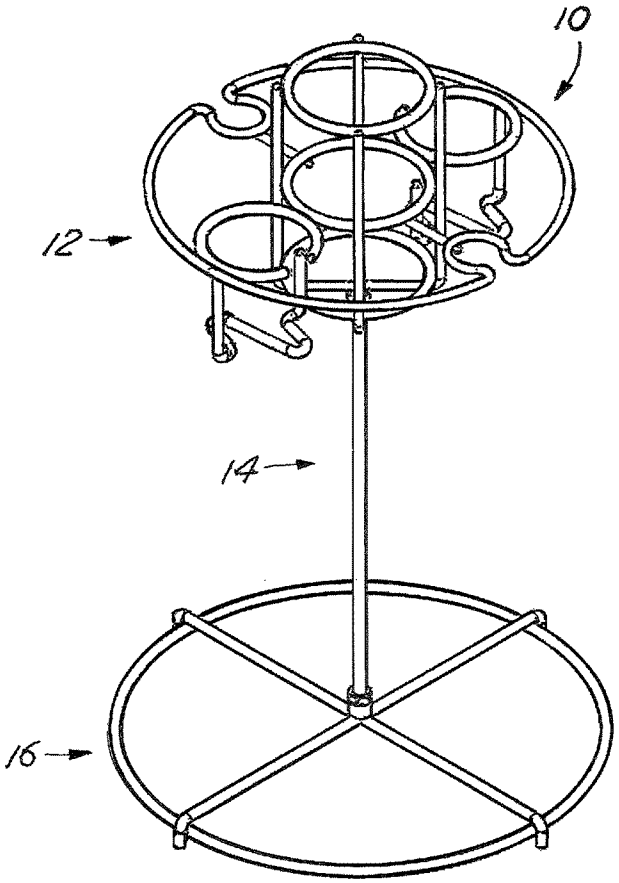
FIG. 9 is an isometric view of the stand.

The top 12 has a major diameter 72 that is slightly smaller than the outer ring 18 as shown in FIG. 4. The major diameter 72 is aligned with and concentric to the center ring 62. As shown in FIG. 2, both the major diameter 72 and the center ring 62 are co-planar and located along plane 110, but it is not required. Stemware holders 52, 54 are formed by bending an arcuate portion 74 inwardly towards the center of the major diameter 72, creating an opening 76. A support rod 78 is affixed at one end to the arcuate portion 74 opposite the opening 76. The other end of the support rod 78 is affixed to the center ring 62. The support rod 78 serves to further stabilize the major diameter 72. The arcuate portion 74 is small enough to prevent common stemware (not shown but typically a vessel such as a wine glass) from falling through, and the opening 76 is large enough to allow the stem of the stemware to pass through. As shown in FIG. 7, the top 12 has two stemware holders 52, 54 that are located opposite each other, but it is contemplated that different angular locations and/or additional stemware holders are included.

Figure 11:
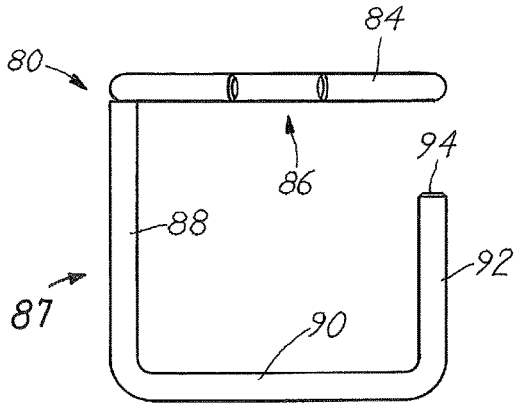
FIG. 11 is a front view of the cup holder only.
Figure 12:
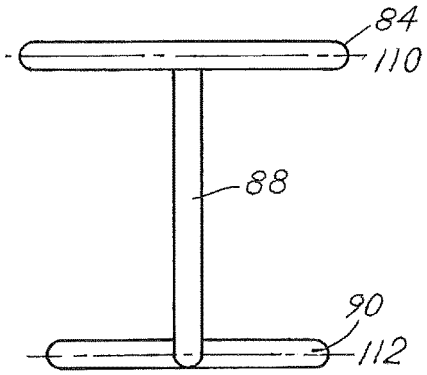
FIG. 12 is a side view of the cup holder only.
Figure 13:
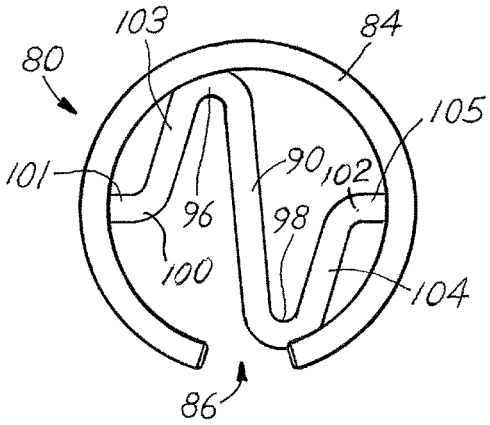
FIG. 13 is a top view of the cup holder only.
Figure 14:
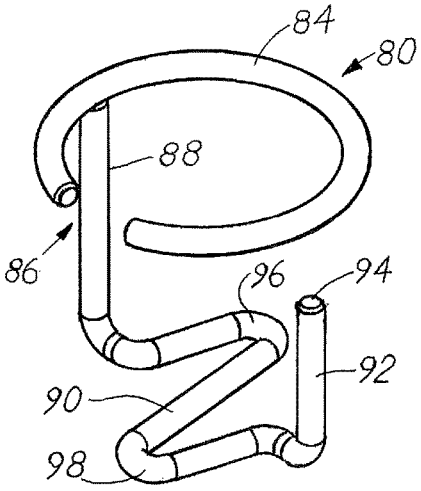
FIG. 14 is an isometric view of the cup holder only.

The top 12 further includes two cup holders 80, 82. As shown, they are located opposite each other, but it is contemplated that different angular locations and/or additional cup holders are included. As with the other parts of the beverage stand 10, they are formed from bent metal wire. The cup holders 80, 82 have a top portion 84 that is circular and has a section missing to create a handle aperture 86. The top portion 84 is also located on plane 110 and attached to the major diameter 72 at a first tangent point 89. Directly across from the first tangent point 89 to the major diameter 72 is a second tangent point 91 where the top portion 84 is affixed to the center ring 62. The handle aperture 86 allows a cup with a handle (common in coffee cups and re-useable water bottles) to be placed into the cup holder 80, 82 without the handle interfering with the top portion 84. The handle aperture 86 is shown as being located at a midpoint between the first tangent point 89 and said second tangent point 91. Extending downwardly from the top portion 84 is a cantilevered support 87. The support 87, as shown in FIG. 11, is formed from a bent metal wire and attached to the top portion 84 where it meets the major diameter 72. It is contemplated that the support 87 is attached in a different location on the top portion 84. The support 87 has a downwardly extending offsetting portion 88 that transitions into a bottom portion 90 that is parallel to plane 110 and spaced from the top portion 84 on plane 112. As shown, the bottom portion 90 is formed by bending the wire into several angles 96, 98. The bottom portion 90 has an insetting portion 101 that meets an obtuse angle 100 that extends to a first chordal section 103. The angle 96 is shown as an acute angle, along with angle 98. Located between angle 96 and angle 98 is a chordal section that intersects a center as viewed through the top portion 84. Another chordal section 104 is substantially mirrored to chordal section 103. Another insetting portion 105 extends from angle 98 and then transitions to another insetting portion 105. The insetting portion 105 transitions to a cradle rod 92. As shown in FIG. 14, the bottom portion 90 is an S-shape, but other shapes are contemplated. The cradle rod 92 extends upwardly from the bottom portion 90 towards the top portion 84 and terminates at an end 94. The cradle rod 92 is shorter than the downwardly extending offsetting portion 88, leaving the end 94 spaced from the top portion 84.

It is understood that while certain aspects of the disclosed subject matter have been shown and described, the disclosed subject matter is not limited thereto and encompasses various other embodiments and aspects. No specific limitation with respect to the specific embodiments disclosed herein is intended or should be inferred. Modifications may be made to the disclosed subject matter as set forth in the following claims.

What is claimed is:

1. A beverage stand adapted to rest on a substantially horizontal surface, said stand comprising:

a base portion being substantially circular with a first circumference and a base attachment located in the center of said first circumference, said base portion having connecting members connecting and extending radially from said base attachment to said first circumference, said base portion having support feet located at a terminal ends of said connecting members opposite said base attachment, said support feet adapted to contact said substantially horizontal surface;

a rod portion being an elongate shaft adapted to be removably affixed to said base portion at said base attachment, said rod portion being substantially perpendicular to said base portion when affixed to said base attachment;

a top portion having an outer ring, said outer ring including an opening having a width defined by opposing inwardly bent radial portions of said outer ring, said bent radial portions integrally continuing to form an arcuate portion having a diameter larger than said opening, said outer ring forming a plane, said top portion having a large vessel holder including a first ring located above said plane and a second ring aligned with said plane and coaxially aligned with said first ring, a support rod connecting said first and second rings, said support rod connected to a floor portion extending radially inward with respect to said first and second rings, a cup holder having an arcuate top ring affixed to said outer ring and said second ring of said large vessel holder, said arcuate top ring having a handle gap interrupting said top ring, said cup holder having a cantilevered cradle rod extending downwardly with respect to said plane, said cradle rod having an offsetting portion extending perpendicularly downward from said plane, said offsetting portion extending into a bottom portion including an insetting portion perpendicular to said offsetting portion and continuing radially inwardly with respect to said top ring into a first chordal section that is along a chord projected from said top ring, said first chordal section extending to a diametrical portion aligned with the diameter of said top ring and a second chordal section continuing from said diametrical portion, said second chordal portion being substantially parallel with respect to said first chordal section and extending to a riser extending upwardly from said second chordal section and said riser being substantially aligned with said top ring and diametrically opposite to said offsetting portion; and when said rod portion is affixed to said top portion and said base portion, said rod and said base attachment are substantially coaxial with said axis.

2. The beverage stand of claim 1, said large vessel holder having a bottom ring being substantially parallel to and spaced from second ring, said bottom ring being adjacent said floor portion.

3. The beverage stand of claim 1, said top being formed from bent metal wire, said wire having a substantially consistent diameter.

4. The beverage stand of claim 3, said bottom portion and said rod being formed from said wire.

5. The beverage stand of claim 1, said support feet being located at a greater radial distance from said base attachment than said first circumference diameter.

6. The beverage stand of claim 1, said top portion having a smaller outside diameter than said first circumference of said base portion.

7. The beverage stand of claim 1, further comprising a second opening being diametrically opposed from said opening.

8. The beverage stand of claim 7, one of said cup holders being diametrically opposed from a second of said cup holders, said cup holders being orthogonally opposed from one of said openings.

9. A beverage stand adapted to rest on a substantially horizontal surface, said stand comprising:

a base portion being substantially circular with a first circumference and a base attachment located in the center of said first circumference, said base portion having connecting members connecting and extending radially from said base attachment to said first circumference, said base portion adapted to contact said substantially horizontal surface;

a rod portion being an elongate shaft adapted to be removably affixed to said base portion at said base attachment, said rod portion being substantially perpendicular to said base portion when affixed to said base attachment;

a top portion having an outer ring, said outer ring including an opening having a width defined by opposing inwardly bent radial portions of said outer ring, said bent radial portions integrally continuing to form an arcuate portion having a diameter larger than said opening, said outer ring forming a plane, said top portion having a large vessel holder including a first ring located above said plane and a second ring aligned with said plane and coaxially aligned with said first ring, a support rod connecting said first and second rings, said support rod connected to a floor portion extending radially inward with respect to said first and second rings, a cup holder having an arcuate top ring affixed to said outer ring and said large vessel holder, said arcuate top ring having a handle gap interrupting said top ring, said cup holder having a cradle rod extending downwardly with respect to said plane, said cradle rod having an offsetting portion extending downwardly from said plane, said offsetting portion extending into a bottom portion and continuing radially inwardly with respect to said top ring and extending to a riser extending upwardly from said bottom portion, said riser being substantially aligned with said top ring and diametrically opposite to said offsetting portion; and when said rod portion is affixed to said top portion and said base portion, said rod portion and said base attachment are substantially coaxial with said axis.

10. The beverage stand of claim 9, said bottom portion including an insetting portion perpendicular to said offsetting portion, said insetting portion extending into a first chordal section that is along a chord projected from said top ring, said first chordal section extending to a diametrical portion aligned with the diameter of said top ring and a second chordal section continuing from said diametrical portion, said second chordal portion being substantially parallel with respect to said first chordal section.

11. The beverage stand of claim 10, said bottom including an insetting portion perpendicular to said offsetting portion and located between said first chordal section and said offsetting portion.

12. The beverage stand of claim 11, said base portion having support feet located at a terminal ends of said connecting members opposite said base attachment, said support feet adapted to contact said substantially horizontal surface.

13. The beverage stand of claim 9, further comprising a second opening being diametrically opposed from said opening.

14. The beverage stand of claim 13, one of said cup holders being diametrically opposed from a second of said cup holders, said cup holders being orthogonally opposed from one of said openings.

15. A beverage stand adapted to rest on a substantially horizontal surface, said stand comprising:

a base portion having a base attachment located in a center, said base portion having connecting members connecting to and extending radially from said base attachment, said base portion adapted to contact said substantially horizontal surface;

a rod portion being an elongate shaft adapted to be removably affixed to said base portion at said base attachment, said rod portion being substantially perpendicular to said base portion when affixed to said base attachment;

a top portion having an outer ring formed from a substantially continuous planar loop, said outer ring including a stem holder with an opening having a width defined by opposing inwardly bent radial portions of said outer ring, said bent radial portions integrally continuing to form an arcuate portion having a diameter larger than said opening, said top portion having a large vessel holder including a first ring located above a plane and a second ring aligned with said plane and coaxially aligned with said first ring, a support rod connecting said first and second rings, said support rod connected to a floor portion extending radially inward with respect to said first and second rings, a cup holder having an arcuate top ring affixed to said outer ring and said large vessel holder, said arcuate top ring having a handle gap interrupting said top ring, said cup holder having a cradle rod extending downwardly with respect to said plane, said cradle rod having an offsetting portion extending downwardly from said plane, said offsetting portion extending into a bottom portion and continuing radially inwardly with respect to said top ring and extending to a riser extending upwardly from said bottom portion, said riser being substantially aligned with said top ring and diametrically opposite to said offsetting portion; and when said rod portion is affixed to said top portion and said base portion, said rod and said base attachment are substantially coaxial with said axis.

16. The beverage stand of claim 15, said bottom portion extending into a first chordal section that is along a chord projected from said top ring, said first chordal section extending to a diametrical portion aligned with the diameter of said top ring and a second chordal section continuing from said diametrical portion, said second chordal portion being substantially parallel with respect to said first chordal section.

17. The beverage stand of claim 16, said base portion having support feet located at a terminal ends of said connecting members opposite said base attachment, said support feet adapted to contact said substantially horizontal surface.

18. The beverage stand of claim 15, further comprising a second opening being diametrically opposed from said opening.

19. The beverage stand of claim 18, one of said cup holders being diametrically opposed from a second of said cup holders, said cup holders being orthogonally opposed from one of said openings.

* * * * *